US008842864B2

(12) United States Patent
Rasmussen et al.

(10) Patent No.: US 8,842,864 B2
(45) Date of Patent: Sep. 23, 2014

(54) HEARING INSTRUMENT COMPRISING A DIVIDED WAX FILTER

(75) Inventors: Karsten Bo Rasmussen, Smørum (DK); Svend Oscar Petersen, Smørum (DK); René Christensen, Smørum (DK); Gabriel Aldaz, Smørum (DK)

(73) Assignee: Oticon A/S, Smorum (DK)

( * ) Notice: Subject to any disclaimer, the term of this patent is extended or adjusted under 35 U.S.C. 154(b) by 216 days.

(21) Appl. No.: 12/899,894

(22) Filed: Oct. 7, 2010

(65) Prior Publication Data

US 2011/0096948 A1 Apr. 28, 2011

Related U.S. Application Data

(60) Provisional application No. 61/254,223, filed on Oct. 23, 2009.

(30) Foreign Application Priority Data

Oct. 23, 2009 (EP) ..... 09173922

(51) Int. Cl.
*H04R 25/00* (2006.01)

(52) U.S. Cl.
CPC ..... *H04R 25/654* (2013.01)
USPC ..... 381/325; 381/322; 381/328; 381/312

(58) Field of Classification Search
USPC ..... 381/322, 324–325, 328, 312, 380; 181/135
See application file for complete search history.

(56) References Cited

U.S. PATENT DOCUMENTS 3,470,328 A * 9/1969 Daniels ..... 381/322
4,375,016 A * 2/1983 Harada ..... 181/135

(Continued)

FOREIGN PATENT DOCUMENTS

DE 84 36 783 U1 5/1986
DE 39 33 584 A1 4/1991

(Continued)

OTHER PUBLICATIONS

European Search Report issued on Feb. 5, 2010 in EP 09173922.7.

(Continued)

*Primary Examiner* — Brian Ensey
*Assistant Examiner* — Sabrina Diaz
(74) *Attorney, Agent, or Firm* — Buchanan Ingersoll & Rooney P.C.

(57) ABSTRACT

The invention relates to a hearing instrument comprising an ITE-part adapted for being positioned in the ear canal of a user, the ITE-part comprising a housing comprising first and second openings adapted for facing towards the ear drum when said ITE-part is mounted in the ear canal, said first and second openings being adapted to allow first and second functional elements of the ITE-part to be in communication with the ear canal, the hearing instrument further comprising a wax filter adapted to fully or partially cover said first and second openings. The invention further relates to the use of a hearing instrument, to a method of wax protection in a hearing instrument and to a wax filter. The object of the present invention is to provide an alternative solution to protect relevant parts of a hearing aid against wax deposition. The problem is solved in that the wax filter comprises at least first and second distinctly different parts for covering respectively, said first and second openings, each of said first and second distinctly different parts of the wax filter being individually optimized. This has the advantage of providing a flexible one-piece wax filter that is optimized according to need. The invention may e.g. be used for the hearing instruments comprising an in-the-ear-part.

11 Claims, 8 Drawing Sheets

(56) References Cited

U.S. PATENT DOCUMENTS

| | | | | |
|---|---|---|---|---|
| 4,879,750 | A * | 11/1989 | Nassler | 381/325 |
| 4,987,597 | A | 1/1991 | Haertl | |
| 5,327,500 | A | 7/1994 | Campbell | |
| 6,000,492 | A * | 12/1999 | Puthuff et al. | 181/135 |
| 6,129,174 | A * | 10/2000 | Brown et al. | 181/135 |
| 7,471,800 | B2 | 12/2008 | Neilson | |
| 2002/0136421 | A1 * | 9/2002 | Topholm | 381/314 |
| 2003/0002700 | A1 | 1/2003 | Fretz et al. | |
| 2006/0147071 | A1 | 7/2006 | Neilson | |
| 2006/0215862 | A1 * | 9/2006 | Huynh et al. | 381/324 |
| 2007/0071265 | A1 * | 3/2007 | Leedom et al. | 381/322 |
| 2008/0075310 | A1 | 3/2008 | Arndt et al. | |
| 2009/0180654 | A1 * | 7/2009 | Nielsen | 381/328 |
| 2010/0086158 | A1 * | 4/2010 | Oberlander | 381/328 |

FOREIGN PATENT DOCUMENTS

| | | | |
|---|---|---|---|
| DE | 102006052436 | A1 | 5/2008 |
| EP | 0 540 862 | A2 | 5/1993 |
| WO | WO 97/09864 | A1 | 3/1997 |
| WO | WO 02/078392 | A2 | 10/2002 |
| WO | WO 2005/096671 | A1 | 10/2005 |

OTHER PUBLICATIONS

Extended European Search Report, issued Jan. 4, 2013, in corresponding application No. EP 12185426.9-2225, 8 pages, published by European Patent Office.

* cited by examiner

HEARING INSTRUMENT COMPRISING A DIVIDED WAX FILTER

TECHNICAL FIELD

The present application relates to wax-protection in hearing aids. The invention relates specifically to a hearing instrument comprising an ITE-part adapted for being positioned in the ear canal of a user, the ITE-part comprising a housing comprising first and second openings adapted for facing towards the ear drum when said ITE-part is mounted in the ear canal, said first and second openings being adapted to allow first and second functional elements of the ITE-part to be in communication with the ear canal, the hearing instrument further comprising a wax filter adapted to fully or partially cover said first and second openings.

The invention furthermore relates to the use of a hearing instrument, to a method of wax protection in a hearing instrument and to a wax filter.

The invention may e.g. be useful in applications such as hearing instruments comprising an in-the-ear-part.

BACKGROUND ART

The deposition of cerumen or wax in or on active parts of hearing aids located in the ear canal (e.g. in-the-ear (ITE) or receiver-in-the-ear (RITE) parts of hearing instruments) is an issue that has to be dealt with. Wax protection in hearing aids is usually implemented by a barrel shaped insert at the tip of ITE-hearing aids or at the tip of the receiver unit in RITE-instruments. The insert typically has small holes to allow the sound to pass while the wax should be held back in the wax protection.

Hearing aids comprising an ITE-part comprising an ear mould typically comprise a vent to avoid or minimize occlusion effects due to the blocking of the ear canal by the mould. To prevent the vent from being blocked by wax, specific measures have to be taken.

WO 97/09864 A1 describes a hearing aid with a cerumen guard comprised of a rigid porous plastic plug adjacent to the exterior surface of the hearing aid shell. The individual cerumen guards may be inserted into the receiver outlet, the microphone inlet, or the vents of the hearing aid.

DE 39 33 584 A1 describes a wax filter of a porous material. The filter can cover receiver and vent outlets in combination or separately.

WO 02/078392 A2 deals with the manufacturing of a hearing aid housing that is individually matched to the shape of the auditory canal of a user, the hearing aid housing being produced with an integrated ventilation channel and possibly an acoustic output opening. Either or both of the acoustic output opening and the ventilation channel opening may be adapted to receive and hold an ear wax guard.

U.S. Pat. No. 4,987,597 describes an apparatus for closing an opening of a hearing aid or an ear adaptor for a hearing aid, particularly openings such as sound entry openings, sound exit openings and aeration openings utilizes a micro-porous membrane of an anti-adhesive material which is introduced into the respective opening. Preferably, the membrane is polytetrafluoroethylene material.

DE 8436783 U1 describes an in the ear hearing aid comprising openings for a speaker outlet as well as for a ventilation channel, which may be covered by a common lid functioning as a wax filter for both openings.

DISCLOSURE OF INVENTION

It is proposed to divide the (possibly barrel shaped) wax filter of an ITE-part of a hearing aid in two functional parts, one part covering the receiver outlet (as is currently done) and the other part covering the vent opening towards the residual space (between the ITE-part and the ear drum). In this way the vent can be protected against wax—something which is known to be a problem for many users. The wax filter should be changed regularly according to the degree of contamination.

A vent in a in-the-ear (ITE) part of a hearing aid is typically not protected by a wax filter. This is because a purpose of the vent is to allow a good propagation (i.e. escape from the occluded volume between the ITE-part and the ear drum) of sound at relatively low frequencies (LF, e.g. lower than 1 kHz) to provide the user with the desired comfort (minimize or avoid occlusion). Sound at relatively higher frequencies (HF, e.g. higher than 1 kHz) should advantageously be attenuated during its passage through the vent. This HF-attenuation relates to the problem of acoustic feedback in the hearing aid which is thereby diminished. The wax-filter located (e.g. covering) in front of the vent can thus advantageously be optimized in the same way that an attenuation element for a hook to a behind-the-ear (BTE) part of a hearing aid is optimized (the hook being the curved tube that leads the sound from a receiver (speaker) located in the BTE-part into the ear canal of a user). In both cases an attenuation element should provide a reduction in the acoustic signal amplitude at frequencies of resonance of the acoustics tube system. In the context of the present application, the attenuation element for the tube system comprising the vent comprises the wax filter. Such preferred optimization of the acoustic attenuation properties of the part of the wax filter adapted for the vent is in contrast to the wax protection needed for the receiver outlet, which solely serves the purpose of wax protection, preferably being acoustically neutral (i.e. to withhold wax without substantially influencing the acoustic signal).

An object of the present invention is to provide an alternative solution to protect relevant parts of a hearing aid against wax deposition.

Objects of the invention are achieved by the invention described in the accompanying claims and as described in the following.

A Hearing Instrument:

An object of the invention is achieved by a hearing instrument comprising an ITE-part adapted for being positioned in the ear canal of a user, the ITE-part comprising a housing comprising first and second openings adapted for facing towards the ear drum when said ITE-part is mounted in the ear canal, said first and second openings being adapted to allow first and second functional elements of the ITE-part to be in communication with the ear canal, the hearing instrument further comprising a wax filter adapted to fully or partially cover said first and second openings wherein the wax filter comprises at least first and second distinctly different parts for covering respectively, said first and second openings, each of said first and second distinctly different parts of the wax filter being individually optimized.

This has the advantage of providing a flexible one-piece wax filter that is optimized according to need.

The term 'opening' is in the present context taken to mean a hole (e.g. a through-going hole) or one or more adjacent holes in the material or part in question.

The term 'be in communication with' is in the present context taken to mean 'capable of exchanging energy with'. In case of a vent or receiver being in communication with a residual volume between the ear drum and an end face of an ITE-part of a hearing instrument, the term 'be in communication with' is taken to mean 'capable of exchanging acoustical (mechanical) energy with', in that sound pressure can be exchanged between the residual volume and the vent or receiver via the opening in question.

The term 'partially cover an opening' is taken to mean that a part of an opening is covered by a material leaving another part of the opening uncovered. The term is intended NOT to exclude that one or more through going holes are present in the material 'partially covering' the opening. The term 'a wax filter adapted to fully cover an opening' is taken to mean that a material of the wax filter covers the opening (e.g., like a lid over a jar), but is intended NOT to exclude that one or more through going holes are present in the material 'fully or partially covering' the opening.

Preferably, the first and second parts of the wax filter are adapted to allow the first and second functional elements of the ITE-part to be in communication with the ear canal. Preferably, a receiver part of the wax filter is adapted to allow appropriate acoustic propagation of sound from the receiver through the receiver part of the wax filter, at least when the wax filter is not tainted with wax. Further, a vent part of the wax filter is preferably adapted to allow at least a part of the sound pressure variations present in the volume between the ITE part and the ear drum of a user to be relieved to the environment through the vent of the ITE part (to minimize the occlusion effect), when the ITE part is operationally mounted in the ear canal.

The term 'being individually optimized' is in the present context taken to mean 'being specifically adapted to'. An element, here e.g. a part of a wax filter, 'being individually optimized' is taken to mean that the element is specifically adapted to its function, e.g. in that its physical properties (e.g. its mechanical or diffusion properties) or its macroscopic structure (e.g. a pattern of holes in the material) are adapted/optimized to its purpose.

The term 'distinctly different parts' is in the present context taken to mean, having different physical (e.g. mechanical or chemical) properties (e.g. comprising different materials, having differently arranged holes or micro-pores, having different wax-diffusion/penetration properties, etc.) or a combination thereof. In an embodiment, surface properties (e.g. adherence properties) of the two distinctly different parts are different.

In a particular embodiment, one of the first and second functional elements is a receiver (speaker). In a particular embodiment, one of said first and second functional elements is a vent. In an embodiment, the first and second functional elements are a receiver and a vent, respectively. In a particular embodiment, the wax filter has a receiver part and a vent part, each part being adapted to fully or partially cover the respective openings.

In a particular embodiment, the vent part of the wax filter is optimized to provide wax protection. In a particular embodiment, the vent part of the wax filter (and the vent) is optimized to allow propagation of sound at relatively low frequencies, e.g. lower than 1.5 kHz, such as lower than 1 kHz (at least when the wax filter is taken into use, (i.e. substantially uncontaminated by wax)), when the wax filter is located in front of the vent in an operational state. This has the advantage of minimizing occlusion perceived by a user. Preferably, the vent part of the wax filter (and the vent) is optimized to provide that sound at relatively higher frequencies (e.g. higher than 1 kHz, such as higher than 1.5 kHz) is attenuated during its passage through the vent and the wax filter. In an embodiment, the vent part of the wax filter (and the vent) is optimized to provide a reduction in the acoustic signal amplitude at frequencies of resonance of the acoustic tube system constituted by the ITE-part, the vent and the wax filter. This has the advantage of minimizing acoustic feedback in the hearing aid. In a particular embodiment, the receiver part of the wax filter is optimized to provide wax protection. In a particular embodiment, the receiver part of the wax filter is optimized to be acoustically neutral (e.g. to provide wax protection without substantially influencing the acoustic signal) (at least when the wax filter is taken into use, (i.e. substantially uncontaminated by wax)).

In a particular embodiment, the housing of the ITE-part comprises at least three openings adapted for facing towards the ear drum, and the wax filter comprises at least three corresponding parts. In an embodiment, one of the openings is for a receiver and two of the openings are vent openings.

In an embodiment, at least one of the different, individually optimized parts of the wax filter is formed as a tubular element comprising a (e.g. barrel shaped) volume for containing wax. In an embodiment, at least one of the different individually optimized parts of the wax filter comprises a filtering element and a volume for containing wax. In an embodiment, the wax filter is adapted to provide that the filtering element is located proximal to the opening it is intended to fully or partially cover, whereas the volume for containing wax is located with an opening in a direction of the ear drum when the wax filter is mounted on the ITE-part and the ITE-part is operationally mounted in an ear canal of a user. In an embodiment, the wax filter is adapted to provide that the volume for containing wax is located proximal to the opening it is intended to fully or partially cover, whereas the filtering element is located proximal to the ear drum when the wax filter is mounted on the ITE-part and the ITE-part is operationally mounted in an ear canal of a user. In an embodiment, the wax filter is adapted to provide that the filtering element is located in such a way that the volume for containing wax is split in individual parts located on each side of the filtering element (cf. e.g. FIG. 4*e*).

In a particular embodiment, the first and second distinctly different parts of the wax filter have different size holes in the faces covering the respective openings. In an embodiment, the holes in the wax filter part (fully or partially) covering a vent outlet are larger than the holes in the wax filter part (fully or partially) covering a receiver outlet. In an embodiment, the area of the holes in the vent part of the wax filter is of substantially equal size. In an embodiment, the areas of the holes in the receiver part of the wax filter are of substantially equal size. In an embodiment, the area (or the average area) of the holes in the vent part of the wax filter is more than twice as large as the area (or the average area) of the holes in the receiver part of the wax filter, such as at least 4 times as large. In an embodiment, the areas of the holes in the receiver part and/or of the vent part of the wax filter are of different size, e.g. relatively smaller at the central part and relatively larger at the peripheral part of the respective wax filter parts. In an embodiment, a central area of a part of the wax filter comprises few (e.g. 1-3 or less than 10% of the total number of holes) or no holes, so that the holes are exclusively or nearly exclusively located in an annular area along the periphery of the part in question. This has the advantage of forcing possible wax penetrating the wax filter part out along the periphery of the underlying (e.g. cylindrical, e.g. barrel shaped volume).

In a particular embodiment, the housing of the ITE-part accommodating the vent and the receiver is adapted to the shape of an ear canal (e.g. of a particular user), and the wax filter has a shape continuing the shape of the housing (in a direction towards the ear drum, when the ITE part is operationally mounted in the ear canal). In an embodiment, the interface between the housing of the ITE part and the wax filter is standardized so that the same wax filter can be used on different (customized) housing parts (moulds). In an embodiment, the ITE-part is not customized to a particular user's ear canal, but rather provided in a standard form and size (possibly in a few forms and standard sizes). In an embodiment, the ITE-part is adapted for being located (at least partially) in the bony part of the ear canal.

In a particular embodiment, the ITE-part is elongate and defines a longitudinal axis or curve, the longitudinal axis or curve following a central longitudinal direction or curve of an ear canal of a user when the ITE part is operationally mounted. In an embodiment, the wax filter (and preferably the ITE-housing interface to which it is to be joined) is spatially asymmetric in a cross section perpendicular to the longitudinal axis or curve. This has the advantage of restricting the possibilities of mounting the wax filter on the ITE-housing to one (correct way). In an embodiment, the wax filter and the housing comprises cooperating structural features to ensure one correct way of mounting the wax filter on the housing of the ITE-part.

In an embodiment, the faces of the wax filter parts adapted for covering the first and second openings are located in the same cross-sectional plane (cf. e.g. FIG. 3).

In a particular embodiment, the faces of the wax filter parts adapted for covering the first and second openings are located in different cross-sectional planes along a centre line or curve of the ear canal of a user when mounted (cf. e.g. FIG. 4). In an embodiment, a perpendicular distance between the different cross-sectional planes is larger than 0.5 mm, such as larger than 1 mm, such as larger than 2 mm. In an embodiment, the distance is optimized to minimize the amount of sound propagating from the receiver through the vent to the outside. This has the advantage of allowing the first and second openings (e.g. the receiver and vent openings) to be positioned at different longitudinal positions. This may have the advantage of minimizing the amount of sound (loss) propagating (leaking) from the receiver through the vent to the outside (and not passing through the wax filter into the residual volume).

In a particular embodiment, the wax filter has a cylindrical or conical outer face (facing the ear canal walls along the longitudinal extension of the ear canal) and an end-face facing towards the ear drum when mounted in an ear canal of a user, and wherein at least one of the faces of the first and second distinctly different parts of the wax filter for covering the respective first and second openings are withdrawn from the end-face of the wax filter facing towards the ear drum thereby creating an indentation in the end-face of the wax filter (cf. e.g. FIG. 4). This has the advantage of allowing the creation of a barrel shaped volume 'in front of' the wax filter part in question, where wax can be stored (and to allow the outlet of the first and second openings to be at different locations along a longitudinal direction).

In a particular embodiment, the wax filter comprises a vent part adapted for partially covering a vent opening and adapted for limiting the effective vent cross section. In an embodiment, the vent part of the wax filter can be used to fine tune the effective vent cross section. In an embodiment, the vent part of the wax filter comprises one or more tongue formed blocking elements. In an embodiment, fine tuning can be made by selecting an appropriate one of a number of different wax filters having differently sized elements adapted for partially covering the vent opening to each their different degree, e.g. tongue formed elements having different areas. The selection of the most appropriate wax filter for the user in question can e.g. be performed by the user him- or herself or by an audiologist during fitting. In an embodiment, the wax filter comprises a receiver part comprising a pattern of holes and a vent part comprising one or more blocking elements partially covering the opening. In an embodiment, the blocking element of the vent part covers less than 70% of the area of the vent opening, such as less than 50%, such as less than 30%, such as less than 20%, such as less than 10% of the area of the vent opening. The choice of blocking element area can preferably be used to optimize the propagation properties of the acoustic system constituted by the vent and the vent part of the wax filter.

In an embodiment, the first and second parts of the wax filter comprise or consist of one common (background or matrix) material. In an embodiment, the matrix material of the wax filter comprises a plastic or rubber material, e.g. polyester urethane foam, or plasticized polyvinyl chloride. This has the advantage that the different properties of the different parts of the wax filter can be achieved by varying e.g. the density, the size, the form and/or pattern arrangement of the holes or micro-pores in the matrix material in the different parts of the wax filter. Alternatively, the first and second parts of the wax filter may comprise different (background or matrix) materials. In an embodiment, a receiver part and/or a vent part of the wax filter comprises a thin film membrane, e.g. of a plastic material. In an embodiment, the thin film membrane comprises one or a few (such as 2 or 3, e.g. centrally located) holes.

In an embodiment, the individual parts of the wax filter each comprise a pattern of regularly spaced circular holes of equal area (diameter). In an embodiment, the patterns and the hole areas are different for the individual wax filter parts and adapted to their functional task (i.e. depending on the functional element coupled to the opening in question). In an embodiment, a pattern is regular (e.g. the centre of the holes forming a regular array). In an embodiment, a pattern is irregular (i.e. not having equidistant holes or the holes may have different form and/or area). In an embodiment, a hole in a part of the wax filter is polygonal, e.g. triangular, or square or hexagonal.

In an embodiment, the hearing instrument is of the completely in the ear canal type (having no associated behind the ear part). In an embodiment, the completely in the ear canal type hearing instrument is of a so-called deep fitting or Bony Sealed type, where at least the receiver (and wax filter) is adapted for being located in the bony part of the ear canal (cf. e.g. FIG. 1*e*).

In an embodiment, the wax filter is an integral part of an ear canal locating part configured to fit within the ear canal. In an embodiment, the ear canal locating part allows sounds outside and within the residual space between the ear drum and the ITE-part to pass through or around the ear canal locating part. In an embodiment, the ear canal locating part has a dome-like form, cf. e.g. US 2003/0002700 A1.

Use:

Use of a hearing instrument as described above, in the detailed description of 'mode(s) for carrying out the invention', and in the claims is furthermore provided by the present invention.

A Method:

In an aspect, a method of wax protection in a hearing instrument, the hearing instrument comprising an ITE-part adapted for being positioned in the ear canal of a user, the ITE-part comprising a housing comprising first and second openings adapted for facing towards the ear drum when said ITE-part is mounted in the ear canal, said first and second openings being adapted to allow first and second functional elements of the ITE-part to be in communication with the ear canal, the hearing instrument further comprising a wax filter adapted to fully or partially cover said first and second openings is moreover provided by the present invention. The method comprises providing that the wax filter comprises at least first and second distinctly different parts for covering respectively, said first and second openings; and providing that each of said first and second distinctly different parts of the wax filter are individually optimized with respect to wax protection.

It is intended that structural features of the hearing instrument described above, in the detailed description of 'mode(s) for carrying out the invention', and in the claims can be combined with the method, when appropriately substituted by a corresponding process. Embodiments of the method have the same advantages as the corresponding devices.

A Wax Filter:

In an aspect, a wax filter for protecting first and second openings of a housing of an ITE-part of a hearing instrument when said ITE-part is mounted in the ear canal is furthermore provided. The wax filter comprises at least first and second distinctly different functional parts adapted to fully or partially cover, respectively, said first and second openings, each of said first and second distinctly different parts of the wax filter being individually optimized in that their physical properties are different.

It is intended that structural features of the hearing instrument described above, in the detailed description of 'mode(s) for carrying out the invention', and in the claims can be combined with the wax filter, when appropriate.

In an embodiment, the wax filter is adapted to a hearing instrument as described above, in the detailed description of 'mode(s) for carrying out the invention', and in the claims.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1 shows different views of a wax filter according to embodiments of the invention.

The division of the wax filter in two parts as shown in FIG. 1 makes it possible to obtain the advantage of having a protection of a vent channel as well as a receiver outlet, while optimizing the two parts according to purpose. Hence, the protection of the vent channel can be more open or have larger holes than the protection of the receiver outlet since the venting shall provide relief from occlusion while being less sensitive to wax than the receiver, which may break down if contaminated with wax.

Figure 1A:
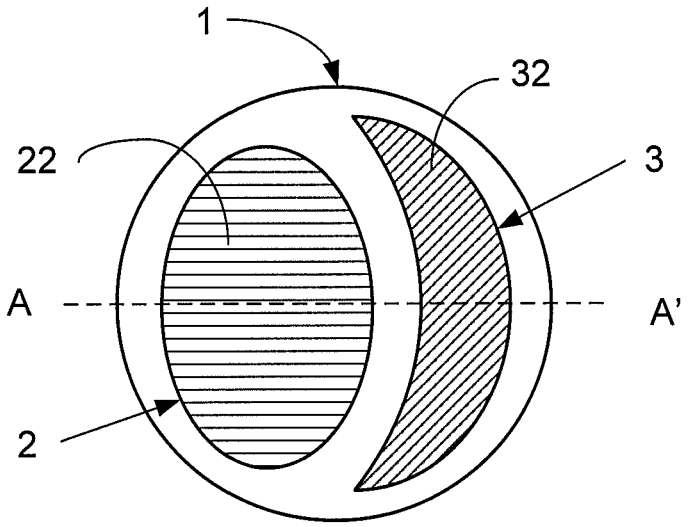
FIG. 1 shows different views of a wax filter according to embodiments of the invention, FIG. 1*a* illustrating first and second distinctly different parts in form and wax penetration properties, FIG. 1*b* being a cross-sectional view the wax filter of FIG. 1*a* along line AA', FIG. 1*c* illustrating first and second distinctly different parts having hole arrangements differing in form, hole size and pattern, FIG. 1*d* showing a wax filter comprising a centrally located receiver part and two peripheral, oppositely located (smaller) vent parts, and FIG. 1*e* showing a completely in the ear canal type hearing instrument comprising a wax filter as shown in FIG. 1*d*.
Figure 1B:
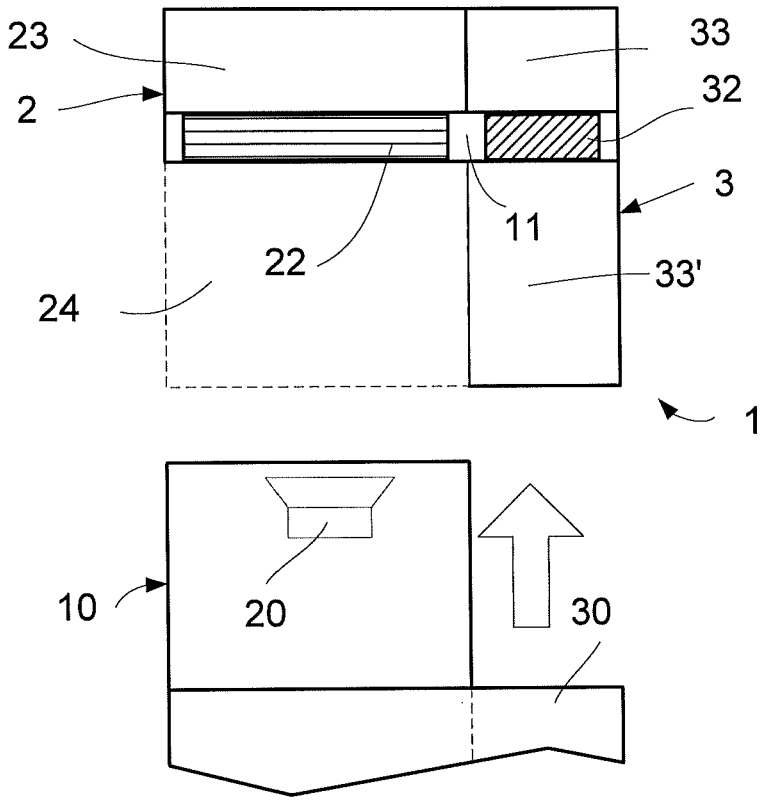
Figure 1C:
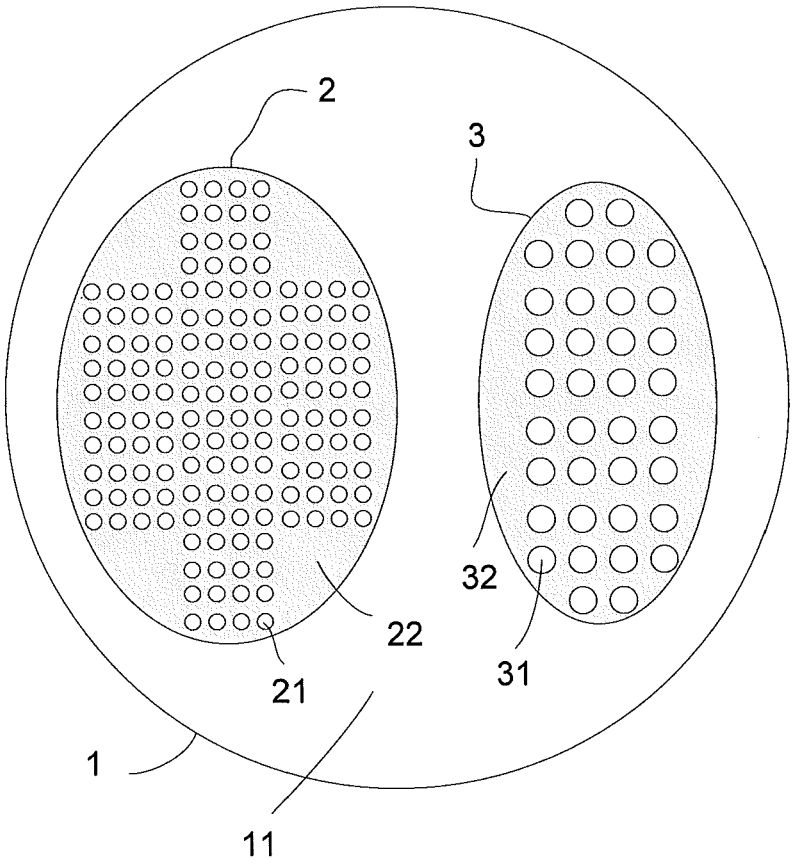

The embodiments of FIG. 1*a*, 1*c* are asymmetric in the views shown (representing an end-view as seen from the ear drum, when the wax filter is mounted on an ITE-part mounted in an ear canal of a user). A cross section of the wax filter is asymmetric in that the cross-sectional pattern only covers itself when rotated a full 360° around a central axis perpendicular to the cross section shown. It is advantageous to create an asymmetrical solution in terms of the two parts of the wax protector specifically adapted for vent and receiver protection, respectively. The idea is that the user can only apply the wax protector in the right way.

FIG. 1*a*, 1*c* illustrates examples as seen from the residual cavity (i.e. unfilled part of the ear canal when an ITE-part is mounted in the ear canal). In the embodiments shown, the wax protector (wax filter) has differently shaped areas allocated to the protection of vent and receiver. In an embodiment, by moving into the barrel (cf. e.g. 23, 33, 33' in the upper part of FIG. 1*b*) of the wax protector 1, the part 3 protecting the vent is prolonged so that in effect a short tube (cf. 33' in the upper part of FIG. 1*b*) exists in front of the venting system. This tubing can contain any wax that may pass through the slightly larger holes of the vent protection part 3 and may also serve as a means of acoustic adjustment of the venting of the hearing aid in order to provide an individually optimized vent for the user without necessarily having to change the remainder of the venting system. The adjustment can be done by changing the cross section of the vent protecting part. Therefore a number of wax protectors offering different vent sizes may be manufactured (cf. e.g. FIG. 2). In the lower part of FIG. 1*b*, a cross-sectional view of the housing 10 of the ITE-part is shown, illustrating the locations of the receiver 20 and the vent 30 relative to the wax filter. The arrow indicates the movement of the housing 10 to join with the wax filter 1, whereby the part of the housing comprising the receiver fills out the corresponding opening 24 in the wax filter 1.

FIG. 1*a* shows an example of a possible shape of the surface of a wax filter 1 pointing towards the ear drum. The hatched areas 2, 3 are intended for being located directly in front of and protecting the receiver outlet (left area, 2) and the vent opening (right area, 3), respectively. The basic idea is to offer wax protection for the vent opening as well as for the receiver opening in cases where the internal vent opening is close to the receiver outlet. The wax protection can be optimized for vent and for receiver, since it will often be optimal to have a more open access to the vent than to the receiver. An asymmetrical geometry, as exemplified by the figure, can ensure that the wax protection can only be mounted in one way.

FIG. 1*c* shows another example of a wax filter 1. The wax filter has a cylindrical or conical shape with a circular cross section (perpendicular to a direction towards the ear drum). The individual parts 2, 3 of the wax filter each comprise a pattern of regularly spaced circular holes 21, 31 of respective equal areas (here diameter). The patterns and the hole areas are different for the two wax filter parts and adapted to their functional task (i.e. depending on the functional element coupled to the opening in question). The patterns may be regular as shown or irregular (i.e. not having equidistant holes or the holes may have different form and/or area). The matrix material 22, 32 of the two parts 2, 3, respectively, of the wax filter may be different and optimized to their individual purposes. Alternatively, the two matrix materials may be equal, but differently optimized to their individual functions, e.g. in their degree of coverage of their respective openings. In an embodiment, the two matrix materials 22, 32 of the two parts 2, 3, respectively, of the wax filter are equal. In an embodiment, the two matrix materials 22, 32 of the two parts 2, 3, respectively, of the wax filter and the material 11 filling the rest of the cross-sectional area are equal. This has the advantage that the wax filter can be made from a single material, each part being optimized by adjusting their diffusion properties (e.g. total cross-sectional area of through-going holes) or degree of coverage of the respective openings.

In an embodiment, the outer surface (e.g. as shown in FIG. 1*c*) is prolonged into the insides of the wax protection filter (thereby continuing the (here regular) pattern of holes to form tubes into/through the matrix material 11, 22, 32 of the wax filter 1).

In an embodiment, the matrix material of the wax filter (11, 22, 32) comprises a plastic material, e.g. PVC or poly urethane.

In an embodiment, the wax filter is manufactured by a moulding process, e.g. in combination with a deposition process (e.g. to add a functional layer, e.g. a hydrophobic coating), and/or by a laser cutting process (e.g. to create appropriate holes in the various parts of the wax filter).

In an embodiment, the matrix material (cf. 22 or 32 in FIG. 1*c*) of the receiver part 2 or vent part 3 of the wax filter 1 is/are adapted to be non-adherent to serumen (and possibly other liquid materials), e.g. by having a hydrophobic surface coating, to provide that serumen is predominantly deposited outside the surface area containing holes. In an embodiment, surfaces outside the areas comprising holes in the receiver part 2 or vent part 3 of the wax filter 1 are hydrophilic to facilitate the adherence of serumen to such parts (e.g. bottom and side walls of a barrel, cf. e.g. 114 in FIG. 4*c*, 4*d*, 4*e*) of the wax filter 1 outside the areas containing holes.

Figure 1D:
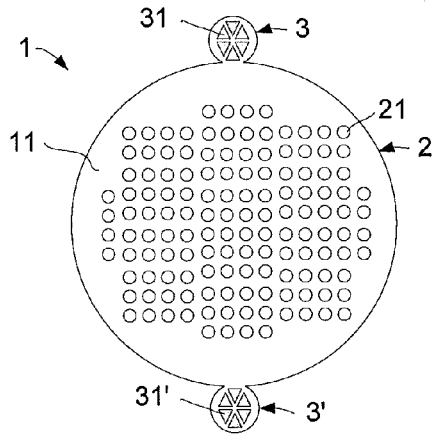
Figure 1E:
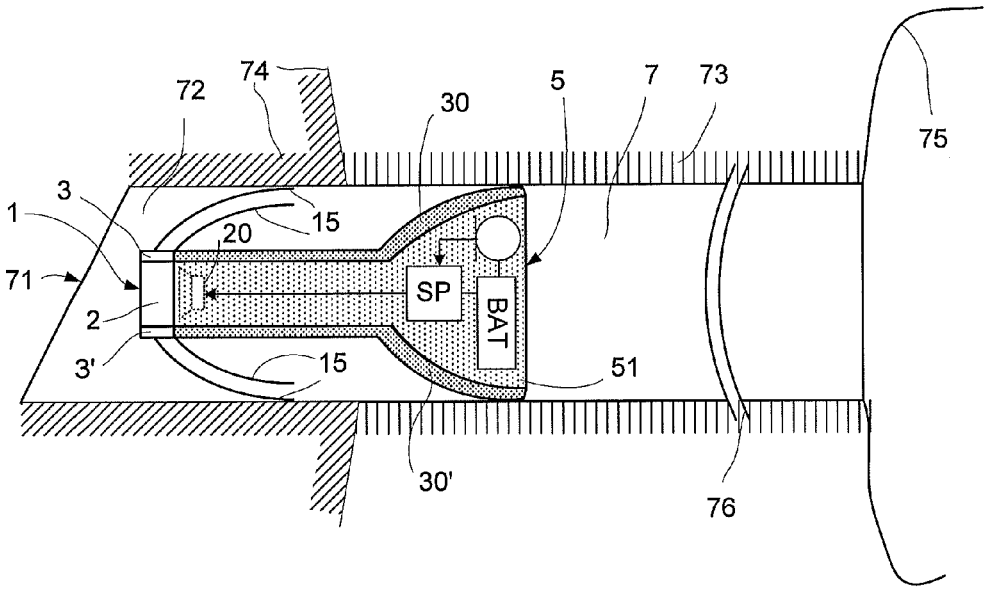

FIG. 1*d* shows a cross-sectional view of a wax filter 1 comprising a relatively large circular central receiver part 2 comprising a regular pattern of (here circular) holes 21 embedded in a matrix material 11. The wax filter further comprises two circular vent parts 3, 3' located opposite along a diameter of the central receiver part 2. The relatively smaller vent parts 3, 3' of the wax filter 1 comprises a regular pattern of (here triangular) holes 31, 31'. The patterns and holes 21, 31, 31' are adapted to their respective functions as receiver and vent protection. FIG. 1*e* shows a cross-sectional view of a hearing instrument 5 adapted for being located fully in an ear canal of a user and comprising a wax filter 1 as shown in FIG. 1*d*. The hearing instrument is a self-contained instrument comprising microphone, battery (BAT) signal processing unit (SP) and receiver 20 (and possibly other relevant functional parts for providing appropriate amplification (or attenuation) of an input sound and presenting it as a processed output sound to the residual volume 72 close to the ear drum 71). The embodiment shown in FIG. 1*e* is adapted for being located at least partially in the bony part 74 of the ear canal 7. The ear canal 7 can have different lengths on different people as indicated by the double arcs 76. The outer ear (pinna) is indicated with reference numeral 75. A first part of the hearing instrument 5 having a relatively small cross section is located at least partially in the bony part 74 of the ear canal 7. A second part of the hearing instrument 5 having a relatively large cross section is located at least partially in the softer part 73 of the ear canal 7. The first part comprises a receiver 20. The second part comprises the more voluminous components, such as e.g. a battery, a signal processing unit, a microphone system, and possible transceiver circuitry. The wax filter 1 is integrated with an ear canal locating part 15, here a dome part comprising one or more structural elements for adapting its/their form to the ear canal and thereby controlling the position of the receiver (e.g. centrally) in a cross section of the ear canal. The hearing instrument comprises two vent channels 30, 30' running along a periphery of the central body 51 of the instrument comprising the electronic components (e.g. BAT, SP, receiver 20, microphone and interconnection circuitry). The hearing instrument may have any other convenient form, and be located elsewhere in the ear canal (e.g. outside the bony part). Likewise a vent of the hearing instrument may be located elsewhere (e.g. internally) and may be present in other numbers than two.

Figure 2A:
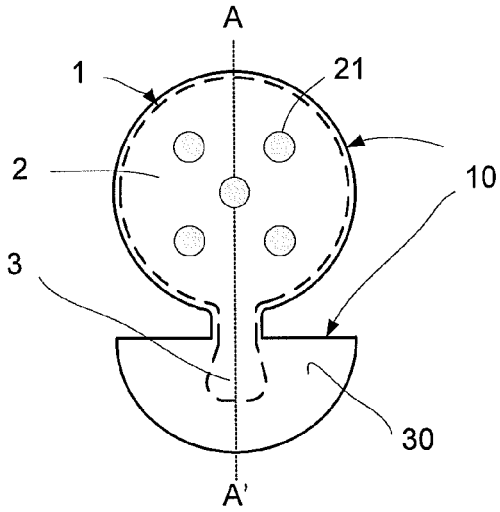
FIG. 2 shows a wax filter according to an embodiment of the invention comprising a combined wax protection and vent-size regulating element, FIG. 2*a* being an end view of the wax filter as located in the housing of an ITE-part of a hearing instrument, FIG. 2*b* being a cross-sectional view of the arrangement in FIG. 2*a* along line AA', and FIG. 2*c* schematically showing cross-sectional views of the combined wax protection and vent-size regulating element with two different sizes of the vent-size regulating element.

FIG. 2*a* shows a cross-sectional (end view) of a housing 10 of an ITE-part and a corresponding wax filter 1 comprising a receiver part 2 and a vent part 3 when the wax filter is mounted on the housing of the ITE-part. The outer periphery of the housing 10 has a substantially circular (upper) part comprising a receiver opening and a substantially semicircular (lower) part comprising a vent opening 30.

The wax filter 1 comprises a circular receiver part 2 for covering the receiver opening (comprising a number of circular holes 21) and a vent part 3 for partially covering the (here) semicircular vent opening 30. The vent part 3 comprises an elongate (tongue formed) vent size regulating part, which can be adjusted in size to cover a larger or smaller part of the vent opening as indicated in FIG. 2*c* by alternative vent part 3' (dashed outline) extending the size of the smaller vent part 3 of the wax filter. In an embodiment, the thickness $d_v$ of the vent part of the wax filter is larger (in a direction perpendicular to the cross-sectional view of FIG. 2*a*) than the thickness $d_r$ of the receiver part of the wax filter (cf. e.g. FIG. 4*b*, 4*d*, 4*e*). In an embodiment, the vent part 3 of the wax filter (as in FIG. 2*b*) has a smaller thickness $d_v$ (in a direction perpendicular to the cross-sectional view of FIG. 2*a*) than the receiver part (having thickness $d_r$) of the wax filter (cf. e.g. FIG. 4*a*, 4*c*). In an embodiment, the vent part of the wax filter 3 extends a length $L_v$ into the typically tubular vent 30, when mounted on the ITE part, cf. e.g. FIG. 2*b*.

Figure 2B:
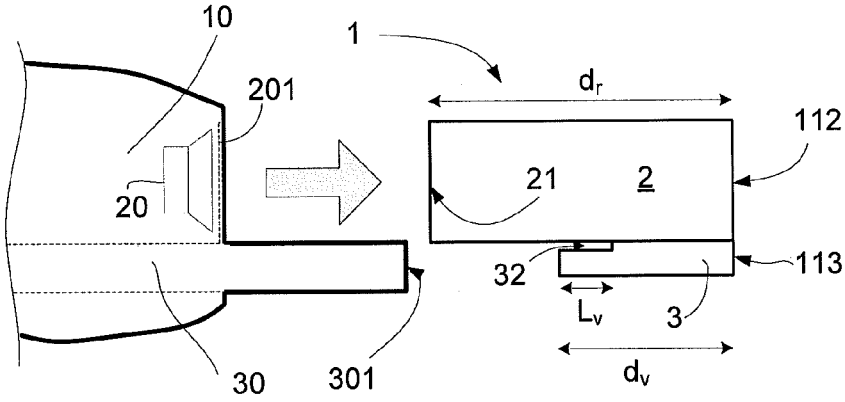
Figure 2C:
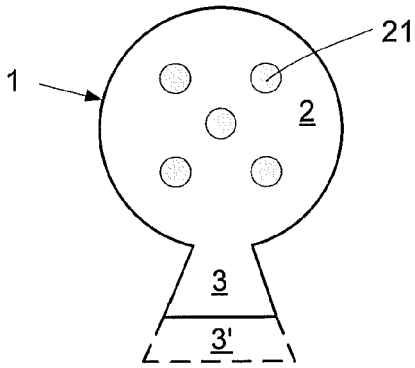

FIG. 2*b* shows a cross-sectional view of the arrangement in FIG. 2*a* along line AA' (the cross-sectional view of the corresponding hearing instrument housing 10 being slightly dislocated from the wax filter for clarity reasons). In the embodiment shown, the housing 10 of the ITE-part comprises a (substantially semi-circular) vent part that extends further in a longitudinal direction towards the ear drum than the end face comprising the receiver opening for conveying sound from the receiver 20 to the ear canal of the user of the ITE part. The corresponding wax filter 1 comprising receiver and vent parts 2, 3 is shown separate from the housing 10 or the ITE-part. The arrow indicates a direction of movement of the ITE-part to appropriately mount the wax filter 1 on the housing 10. The housing 10 comprises indentation 201 adapted to receive end face 21 of the receiver part of the wax filter. Correspondingly, the vent part 3 of the wax filter comprises indentation 32 adapted to receive end face 301 of the vent 30 of the housing. The vent size regulating part 3 is thereby adapted to extend a length $L_v$ into the vent opening of the housing 10, when the wax filter is appropriately mounted on the end face of the housing. This thickness $d_v$ of the vent size regulating part and its extension into the vent opening (together with the cross-sectional area of the vent size regulating element relative to the area of the vent, see FIG. 2*a*, 2*c*) are adapted to provide a desired effective vent size. In the embodiment shown in FIG. 2*b*, the end face of the wax filter facing the ear drum when mounted on the ITE-part (comprising end faces 112 and 113 of the receiver and vent parts, respectively) is even. This need not be so, however, as illustrated in the embodiments of FIG. 4. In the embodiment of FIG. 2, a dimension of the wax filter in a longitudinal direction of an ear canal (thicknesses d, $d_v$, $d_r$) is larger than a dimension in a cross section of the ear canal. This need not be so, however, and can e.g. be opposite, depending on the application in question (as e.g. indicated in FIG. 4).

FIG. 2*c* schematically shows cross-sectional views of the combined wax protection and vent-size regulating element with two different sizes of the vent-size regulating element. In an embodiment, the area of the vent opening covered by the vent size regulating element is in the range from 0.1 to 0.9 of the vent opening. Preferably, the area of the vent opening covered by the vent size regulating element is less than 50% of the opening, e.g. less than 25%, e.g. less than 15%. In an embodiment, the area of the vent opening covered by the vent size regulating element is in the range from 30% to 60% of the area of the vent opening in a common cross section.

Figure 3A:
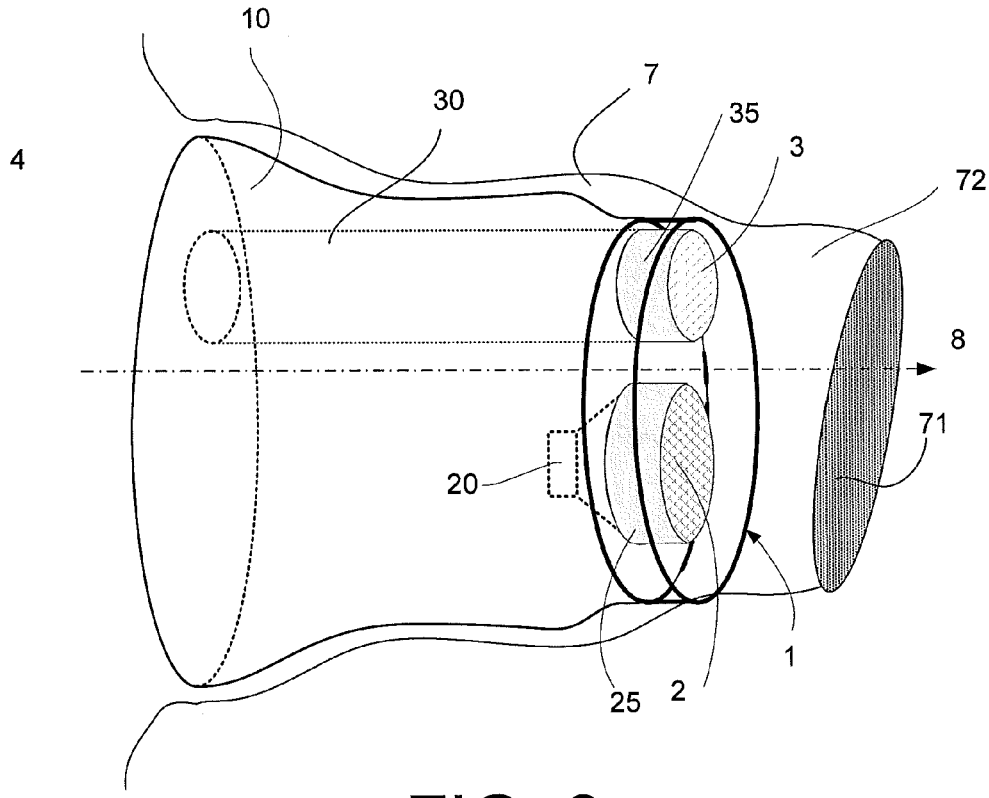
FIG. 3*a* shows an ITE-part with wax filter mounted in an ear canal of a user, FIGS. 3*b* and 3*c* illustrating perspective view examples of the wax filter.
Figure 3B:
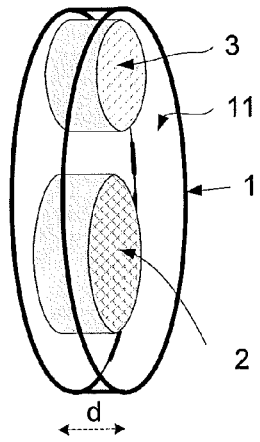
FIG. 3 shows an example of an ITE-part of a hearing instrument comprising an embodiment of a wax filter.
Figure 3C:
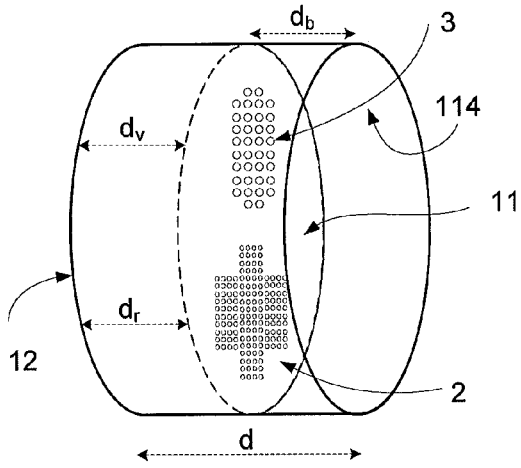

FIG. 3 shows an example of an ITE-part of a hearing instrument comprising an embodiment of a wax filter. FIG. 3*a* shows an ITE-part of a hearing instrument comprising a housing 10 adapted in size and form for being mounted in an ear canal 7 of a user. The housing encloses various functional parts of the hearing instrument, e.g. a vent 30 for minimizing the occlusion effect and a receiver 20 for converting an electric output signal to an acoustic signal. Corresponding openings in the housing allows the vent to exchange acoustic energy with the surroundings 4 and the acoustic signal to be fed to the residual volume 72 enclosed by the ITE part and the ear canal and perceived by the user via the ear drum 71. The wax filter 1 comprising receiver and vent parts 2, 3 for protecting, respectively, the receiver and vent openings, is mounted on the end face of the housing of the ITE-part to fully or partially cover the receiver and vent openings. A longitudinal direction of the ITE-part indicating a direction towards the ear drum of the user is indicated by dashed arrow 8. Embodiments of the wax filter 1 alone are shown in FIGS. 3*b* and 3*c*. FIG. 3*b* shows the disk-formed wax filter 1 of FIG. 3*a* of thickness d. The wax filter 1 comprises through-going different functional parts 2, 3 of the wax filter embedded in a matrix material 11. FIG. 3*c* shows a barrel shaped wax filter 1 comprising a disk-formed part (e.g. as shown in FIG. 3*b*) and a cylindrical, tubular outer wall forming a barrel 114 with the upper (common, co-planar) face of the disk formed part of the wax filter. The bottom part 12 of the wax filter is adapted for being mounted on the housing 10 of an ITE part of a hearing instrument in a click-on manner, preferably in only one correct way, e.g. using a specific tool. In an embodiment, the wax filter is clicked-on and then rotated until another click indicates the correct position, so that receiver and vent parts are positioned correctly relative to the receiver and vent openings. The vent part 3 comprises a first regular pattern of relatively larger holes. The receiver part 2 comprises a second regular pattern of relatively smaller holes. The holes of the vent and receiver parts 3, 2 are embedded in a common matrix material, e.g. a plastic material. The vent and receiver parts have the same thickness $d_v$, $d_r$. The barrel has a height $d_b$ and the total thickness of the wax filter inclusive barrel is d. A typical thickness is of the order of mm, e.g. in the range from 0.5 mm to 5 mm, such as between 1 mm and 2 mm.

FIG. 4 shows different embodiments of an exemplary wax filter where first and second parts of the wax filter are located in a non-coplanar arrangement. FIG. 4 illustrates embodiments of a wax filter 1 comprising first 2 and second 3 wax filter parts, whose outer faces 112, 113, respectively, adapted for facing the ear drum when mounted, are not located in the same cross-sectional plane of the wax filter (when viewed in a longitudinal direction of the filter, cf. 8 in FIG. 3*a*). In FIGS. 4*a* and 4*c*, the height $d_r$ of the first part 2 (e.g. a receiver part) of the wax filter is larger than the height $d_v$, of the second part 3 (e.g. a vent part) of the wax filter, whereas the opposite is the case in the embodiments of FIG. 4*b*, 4*d*, 4*e*. The step between the outer end faces 112, 113 of the first and second parts, respectively, is indicated by height $d_s$. In an embodiment, the maximum dimension d of the wax filter in a longitudinal direction, taken from a common bottom face 12 adapted for facing the housing of the ITE-part when operationally mounted thereon, is equal to the height of one of the wax filter parts (cf. FIG. 4*a*, 4*b*, 4*c*). In an embodiment, the height $d_s$. is larger than 0.5 mm, e.g. larger than 1 mm. In the following the first part 2 is denoted the receiver part whereas the second part 3 is denoted 'the vent part' of the wax filter. The transition in all embodiments of FIG. 4 between end faces 112 and 113 of the receiver and vent parts, respectively, is shown to be abrupt in the form of a step of size $d_s$. Alternatively, the transition may be less abrupt and comprise a gradual, e.g. continuous or step-wise (comprising a number of smaller steps) adaptation of the level difference. Similarly, in all embodiments of FIG. 4, the wax filter is shown to have a common bottom face 12. This need not be the case, however. The or an additional level difference between the dedicated parts of the wax filter may be implemented on this part of the filter facing (and adapted for being joined with) the housing (when said housing is correspondingly adapted, cf. e.g. FIG. 1*b*7).

Figure 4A:
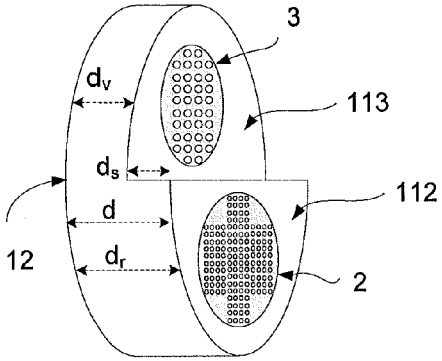
FIG. 4 shows five different embodiments (FIG. 4*a*-4*e*) of an exemplary wax filter where first and second parts of the wax filter are located in a non-coplanar arrangement.

The patterns of holes and the (possibly different) matrix materials wherein the holes are made in the receiver and vent parts of the wax filter of FIG. 4*a* are identical to those of the embodiment of FIG. 1*c*. The height $d_r$ of the receiver part is larger than the height $d_v$ of the vent part of the wax filter, as counted from their common bottom face 12.

Figure 4B:
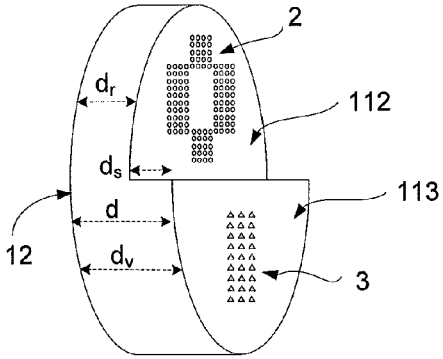

In the embodiment of FIG. 4*b*, the holes of the receiver part 2 and vent part 3 are embedded in the same matrix material. The—otherwise regular—hole pattern (comprising arrays of circular holes) of the receiver part 2 comprises a central part with no holes. The vent part 3 of the wax filter comprises an array of polygonal holes (here indicated as triangular holes). The height $d_r$ of the receiver part is smaller than the height $d_v$ of the vent part of the wax filter, as counted from their common bottom face 12.

Figure 4C:
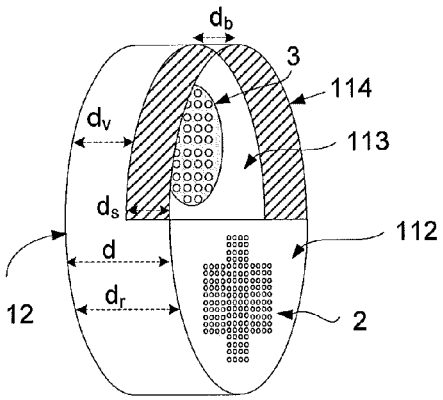

In the embodiment of FIG. 4*c*, thicknesses ($d_v$, $d_r$) and step size ($d_s$), the hole patterns and hole sizes of the vent and receiver parts of the wax filter are the same as in the embodiment of FIG. 4*a*. The holes of the receiver part 2 of the wax filter are however embedded in the general matrix material (cf. 11 in FIGS. 1 and 3*c*) of the wax filter (i.e. NOT in a separate, dedicated matrix material as in FIG. 4*a*, or in FIG. 1*c* (cf. reference numeral 22)). Further, a barrel volume is constituted by a semicircular wall 114 of height $d_b$ (here equal to the step height $d_s$), the step between the two parts of the wax filter and the upper surface 113 of the vent part of the wax filter. This volume is adapted to contain a specific maximum amount of serumen depending on the application.

Figure 4D:
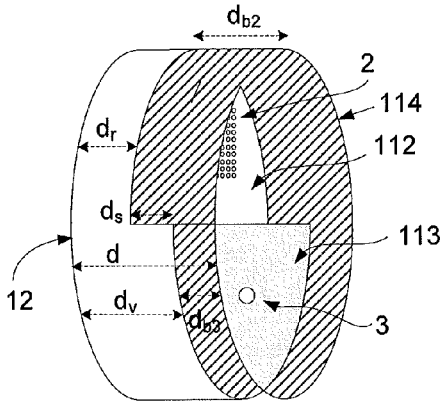

In the embodiment of FIG. 4*d*, thicknesses ($d_v$, $d_r$) and step size ($d_s$), the hole pattern and hole sizes of the receiver part 2 of the wax filter 1 are the same as in the embodiment of FIG. 4*b*. The vent part 3 of the wax filter comprises only one central hole, which is embedded in a dedicated matrix material (cf. 32 in FIG. 1*c*) of the wax filter. In an embodiment, the dedicated matrix material comprises a foil membrane, e.g. C-Barrier™ (of Pulse Engineering Inc.). Further, a barrel volume is constituted by a circular wall 114, aligning the step (of height $d_s$) between the two parts of the wax filter and extending beyond the upper surface 113 of the vent part 3 of the wax filter. The semicircular wall of the barrel of the receiver part 2 of the wax filter has a height $d_{b2}$, whereas the semicircular wall of the barrel of the vent part 3 of the wax filter has a height $d_{b3}$. In the present embodiment, to make the barrel rim even, $d_{b2}=d_{b3}+d_s$. This volume is adapted to contain a specific maximum amount of serumen depending on the application (by adapting the barrel height parameters $d_{b2}$, $d_{b3}$ and the areas of the upper surfaces 112 and 113 of the receiver and vent parts, respectively).

Figure 4E:
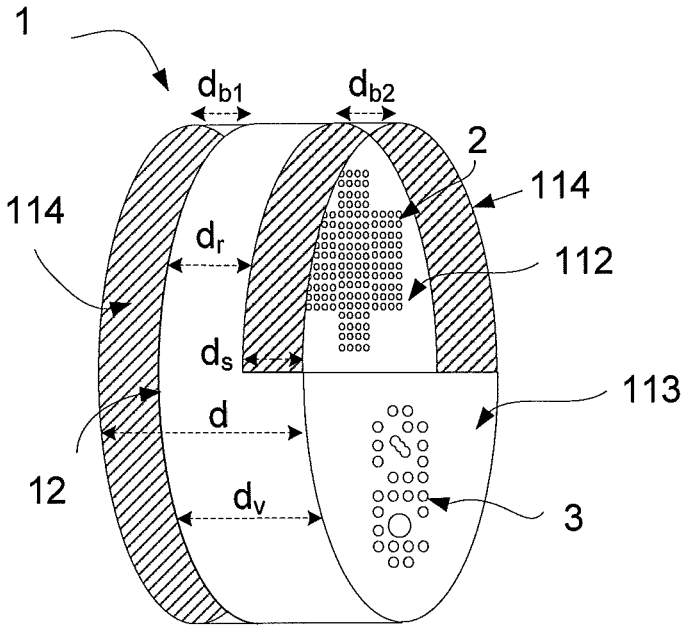

In the embodiment of FIG. 4*e*, thicknesses ($d_v$, $d_r$) and step size ($d_s$) of the vent and receiver parts of the wax filter are the same as in the embodiment of FIG. 4*b*. The pattern and size of the holes of the receiver part 2 of the wax filter are the same as in FIG. 4*c*. The pattern and size of the holes of the vent part 3 of the wax filter are irregular, comprising different size holes that are not positioned in a periodic array structure. This may be used to customize different areas of the wax filter part differently. A barrel volume is constituted by a semicircular wall 114 of height $d_{b2}$ (here equal to the step height $d_s$), the step between the two parts of the wax filter and the upper surface 112 of the receiver part of the wax filter. This volume is adapted to contain a specific maximum amount of serumen depending on the application. Further, a barrel volume is constituted by a circular wall 114 of height $d_{b1}$ and the end face 12 of the wax filter facing the housing and openings of the ITE parts. The latter barrel can be considered as an adaptation to the particular form of the housing in question and need not have an even periphery but can be irregular in its form. It can further collect possible serumen that penetrates the filter and collect it (e.g. by adherence to the walls of the barrel) before reaching the opening in question.

Preferably, the wax filter is substituted by a clean one when the holes of the filter are covered and/or when the volume of a possible barrel is full or partially full.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

References

WO 97/09864 A1 (ARGOSY ELECTRONIC) 13 Mar. 1997
DE 3933584 A1 (ROBERT BOSCH) 11 Apr. 1991
US 2003/0002700 A1 (Fretz et al.) 2 Jan. 2003
WO 02/078392 A2 (WIDEX) 3 Oct. 2002
U.S. Pat. No. 4,987,597 (SIEMENS) 22 Jan. 1991
DE 8436783 U1 (SIEMENS) 22 May 1986

The invention claimed is:

1. A method of wax protection in a hearing instrument, the hearing instrument comprising an ITE-part adapted for being positioned in the ear canal of a user, the ITE-part comprising a housing comprising first and second openings adapted for facing towards the ear drum when said ITE-part is mounted in the ear canal, said first and second openings being adapted to allow first and second functional elements of the ITE-part to be in communication with the ear canal, the hearing instrument further comprising a wax filter adapted to fully or partially cover said first and second openings, and an ear canal locating part comprising one or more structural elements for controlling a position of a receiver in a cross section of the ear canal, the method comprising:

providing that the wax filter comprises at least first and second distinctly different parts for covering respectively, said first and second openings; and providing that each of said first and second distinctly different parts of the wax filter are individually optimized with respect to wax protection, wherein one of said first and second functional elements is a vent, wherein the wax filter comprises a vent part adapted for partially covering a vent opening and adapted for limiting the effective vent cross section, wherein the vent part of the wax filter comprises a tongue formed blocking element, wherein the tongue formed blocking element partially covers the vent opening, wherein the size of the tongue formed blocking element is adapted to optimize the effective vent cross section.

2. A method of wax protection in a hearing instrument according to claim 1, wherein the wax filter is an integral part of said ear canal locating part.

3. A method of wax protection in a hearing instrument according to claim 1, wherein the tongue formed blocking element covers less than 70% of the area of the vent opening.

4. A wax filter and ear canal locating part for protecting first and second openings of a housing of an ITE-part of a hearing instrument when said ITE-part is mounted in the ear canal, the wax filter comprising at least first and second distinctly different functional parts adapted to fully or partially cover respectively, said first and second openings, each of said first and second distinctly different parts of the wax filter being individually optimized in that their physical properties are different, wherein the wax filter is an integral part of said ear canal locating part, the ear canal locating part comprising one or more structural elements for controlling a position of a receiver in a cross section of the ear canal, wherein the wax filter comprises a vent part adapted for partially covering a vent opening and adapted for limiting the effective vent cross section, wherein the vent part of the wax filter comprises a tongue formed blocking element, wherein the tongue formed blocking element partially covers the vent opening, wherein the size of the tongue formed blocking element is adapted to optimize the effective vent cross section.

5. A wax filter and ear canal locating part according to claim 4, wherein the tongue formed blocking element is adapted for covering less than 70% of the area of the vent opening.

6. A hearing instrument comprising an ITE-part adapted for being positioned in the ear canal of a user, the ITE-part comprising:

a housing comprising a receiver outlet and a vent opening adapted for facing towards the ear drum when said ITE-part is mounted in the ear canal, said receiver outlet and said vent opening being adapted to allow receiver and vent functional elements, respectively, of the ITE-part to be in communication with the ear canal, a wax filter adapted to fully or partially cover said receiver outlet and said vent opening, wherein the wax filter is a one-piece wax filter comprising at least first and second distinctly different parts for covering respectively, said receiver outlet and said vent opening, each of said first and second distinctly different parts of the wax filter being individually optimized with respect to wax protection, wherein the outer faces of the wax filter adapted for covering the receiver outlet and said vent opening are located in different cross-sectional planes of the wax filter along a centre line or curve of the ear canal of the user when mounted, and wherein the distance between the different cross-sectional planes is optimized to minimize the amount of sound propagating from the receiver outlet through the vent opening to the outside.

7. A hearing instrument according to claim 6, wherein the transition between the outer faces of the receiver and vent parts, respectively, of the wax filter, is abrupt in the form of a step of size.

8. A hearing instrument according to claim 6, wherein the transition between the outer faces of the receiver and vent parts, respectively, of the wax filter, is gradual.

9. A hearing instrument according to claim 6, wherein the height of the receiver part is larger than the height of the vent part of the wax filter, as counted from their common bottom face.

10. A hearing instrument according to claim 6, wherein the vent part of the wax filter further comprises holes, wherein the pattern and size of the holes of the vent part of the wax filter are irregular, comprising different sized holes that are not positioned in a periodic array structure.

11. A wax filter for protecting a receiver outlet and a vent opening of a housing of an ITE-part of a hearing instrument when said ITE-part is mounted in an ear canal, the wax filter comprising at least first and second distinctly different functional parts adapted to fully or partially cover respectively, said receiver outlet and said vent opening, each of said first and second distinctly different parts of the wax filter being individually optimized with respect to wax protection in that their physical properties are different, wherein the wax filter is a one-piece wax filter, wherein the first and second distinctly different parts of the wax filter adapted for covering the receiver outlet and said vent opening are located in different cross-sectional planes along a centre line or curve of the ear canal of a user when said wax filter is mounted on said ITE-part, and wherein the distance between the different cross-sectional planes is optimized to minimize the amount of sound propagating from the receiver outlet through the vent opening to the outside.

* * * * *